US006478855B1

(12) United States Patent
Okano

(10) Patent No.: US 6,478,855 B1
(45) Date of Patent: Nov. 12, 2002

(54) METHOD OF DEHUMIDIFYING AND DEHUMIDIFIER WITH HEAT EXCHANGER HAVING FIRST AND SECOND PASSAGES AND MOISTURE COOLING IN THE SECOND PASSAGES

(75) Inventor: Hiroshi Okano, Fukuoka (JP)

(73) Assignee: Seibu Giken Co., Ltd., Fukuoka (JP)

( * ) Notice: Subject to any disclaimer, the term of this patent is extended or adjusted under 35 U.S.C. 154(b) by 0 days.

(21) Appl. No.: 09/650,863

(22) Filed: Aug. 29, 2000

(30) Foreign Application Priority Data

Aug. 30, 1999 (JP) ..... 11-243739

(51) Int. Cl.[7] ..... B01D 53/06

(52) U.S. Cl. ..... 95/113; 95/121; 95/123; 95/126; 96/125; 96/143; 96/145

(58) Field of Search ..... 95/113, 116, 117, 95/121, 122, 123, 124, 126; 96/125, 143, 144, 145, 146

(56) References Cited

U.S. PATENT DOCUMENTS

| | | | | |
|---|---|---|---|---|
| 3,446,031 A | * | 5/1969 | Chi et al. | 96/125 |
| 3,683,591 A | * | 8/1972 | Glav | 96/146 |
| 3,708,956 A | | 1/1973 | Norback | |
| 4,377,400 A | | 3/1983 | Okamoto et al. | |
| 4,484,938 A | | 11/1984 | Okamoto et al. | |
| 4,582,129 A | | 4/1986 | Yano et al. | |
| 4,926,618 A | | 5/1990 | Ratliff | |
| 5,584,916 A | | 12/1996 | Yamashita et al. | |
| 5,817,167 A | * | 10/1998 | DesChamps | 95/113 |
| 6,165,254 A | | 12/2000 | Kawakami et al. | |

FOREIGN PATENT DOCUMENTS

| | | | |
|---|---|---|---|
| JP | 58-8284 | | 2/1983 |
| JP | 59-130521 | | 7/1984 |
| JP | 62-68520 | | 3/1987 |
| JP | 62-97626 | | 5/1987 |
| JP | 1-99630 | | 4/1989 |
| JP | 3-188918 | | 8/1991 |
| JP | 7-19789 | * | 1/1995 |

OTHER PUBLICATIONS

Translation of Laid–Open Japanese Patent No. 5–15736 dated May 1993.
Translation of Laid–Open Japanese Patent No. 6–31132 dated Feb. 1994.
Translation of Laid–Open Japanese Patent No. 6–63345 dated Mar. 1994.

* cited by examiner

*Primary Examiner*—Robert A. Hopkins
(74) *Attorney, Agent, or Firm*—Staas & Halsey LLP

(57) ABSTRACT

A heat exchanger, perhaps a cross flow heat exchanger, has first and second passages. During dehumidification (adsorption of moisture) in the first passages, water is evaporated from the second passages. This water can be introduced to the second passages during reactivation (desorption of moisture) in the first passages or at another time. If the water is introduced to the second passages during reactivation, the first and second passages have therein first and second moisture adsorbents. During a first time period, air to be dehumidified is passed through the first passages of the heat exchanger and cooling air is passed through the second passages of the heat exchanger to remove heat generated in the first passages and to desorb moisture adsorbed by the second moisture adsorbent. During a second time period, a heating fluid is passed through the second passages of the heat exchanger to heat the first passages and supply moisture for adsorption to the second moisture adsorbent. Also during the second time period, removal air is passed through the first passages of the heat exchanger to eliminate water adsorbed by the first moisture adsorbent during the first time period. If water is introduced to the second passages at a time other than during reactivation, it is not necessary for the second passages to have a moisture adsorbent therein. The water could be introduced to the second passages as a spray during the first time period (during dehumidification).

29 Claims, 9 Drawing Sheets

METHOD OF DEHUMIDIFYING AND DEHUMIDIFIER WITH HEAT EXCHANGER HAVING FIRST AND SECOND PASSAGES AND MOISTURE COOLING IN THE SECOND PASSAGES

CROSS-REFERENCE TO RELATED APPLICATIONS

This application is based upon and claims priority to Japanese Patent Application No. Heisei 11-243739 filed Aug. 30, 1999, the contents of which are incorporated herein by reference.

BACKGROUND OF THE INVENTION

Conventionally, refrigeration type and adsorption type dehumidifiers have been used. Also, a dry type dehumidifier having a honey-comb rotor with silica gel fixed thereto has been used in recent years. The dry type dehumidifier with the honey-comb rotor is suitable to provide air having a low dew point, i.e., low absolute humidity. However, dry type dehumidifiers are limited in their ability to produce very dry air for the following reasons. Dry type dehumidifiers using the honey-comb rotor generate adsorption heat when the adsorbent, such as silica gel, adsorbs moisture in the air to be dehumidified. Since the temperature of the air to be dehumidified increases, the relative humidity decreases. However, the dew point (absolute humidity) is still too high. It is difficult to decrease the absolute humidity when the relative humidity is low.

To improve the performance of a dry type dehumidifier using a honey-comb rotor, the air to be dehumidified could be cooled before processing. To avoid this, Japanese Published Application No. Showa 62-68520 proposes using the honey-comb rotor as a sensible heat exchanger with an air stream through the rotor removing adsorption heat so that the honey-comb rotor can dehumidify.

The technology indicated by the above-mentioned reference is related to equipment which adsorbs the moisture in processed air, and cools the honey-comb rotor using an air stream derived from the atmosphere. The system releases adsorption heat to thereby avoid a drop off in the dehumidification.

However, despite the cooling air stream, the temperature of the honey-comb rotor may still increase because of the adsorption heat. Therefore, the system disclosed in Japanese Patent Publication No. 62-68520 may still experience some drop off in the dehumidification ability.

SUMMARY OF THE INVENTION

Accordingly, it is an object to the present invention to solve the above problems and avoid any drop off in the dehumidification ability.

These and another objects are accomplished by providing a heat exchanger, perhaps a cross flow heat exchanger, having first and second passages. During dehumidification (adsorption of moisture) in the first passages, water is evaporated from the second passages. This water can be introduced to the second passages during reactivation (desorption of moisture) in the first passages or at another time.

If the water is introduced to the second passages during reactivation, the first and second passages have therein first and second moisture adsorbents. During a first time period, air to be dehumidified is passed through the first passages of the heat exchanger and cooling air is passed through the second passages of the heat exchanger to remove heat generated in the first passages and to desorb moisture adsorbed by the second moisture adsorbent. During a second time period, a heating fluid is passed through the second passages of the heat exchanger to heat the first passages and supply moisture for adsorption to the second moisture adsorbent. Also during the second time period, removal air is passed through the first passages of the heat exchanger to eliminate water adsorbed by the first moisture adsorbent during the first time period.

If water is introduced to the second passages at a time other than during reactivation, it is not necessary for the second passages to have a moisture adsorbent therein. Warm air is passed through the second passages during the second time period to heat the first passages. To supply moisture, a spray device may supply a large amount of misty minute liquid drops to the second passages during the first time.

The first moisture adsorbent in the first passages of the heat exchanger may be a silica gel, an ion exchange resin, or a hydrophilic zeolite. The second moisture adsorbent in the second passages may be a silica gel, an ion exchange resin, a hydrophilic zeolite, or a nonwoven fabric. Alternatively, the second moisture adsorbent may be formed by surface processing on the surfaces of the second passages.

The heating fluid may be warm humid air, and the dehumidifier may have a heating and humidifying device to receive air exiting the second passages of the heat exchanger during the second time period, to heat and humidify the air, and to pass the warm humid air through the second passages of the heat exchanger as the heating fluid.

A plurality of heat exchangers may be arranged in a circular configuration and rotatably supported by a frame so that a first portion of the heat exchangers perform in the first time period while concurrently a second portion of the heat exchangers perform in the second time period.

The dehumidifier may have a heater and a desorption heat exchanger. The heater heats the removal air in the second time period before passing the removal air through the first passages of the heat exchanger. The desorption heat exchanger has first and second passages. The first passages of the desorption heat exchanger receive air exiting the first passages of the heat exchanger during the second time period. Also during the second time period, the second passages of the heat exchanger receive removal air before the removal is heated by the heater.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DESCRIPTION OF THE PREFERRED EMBODIMENTS

Figure 1:
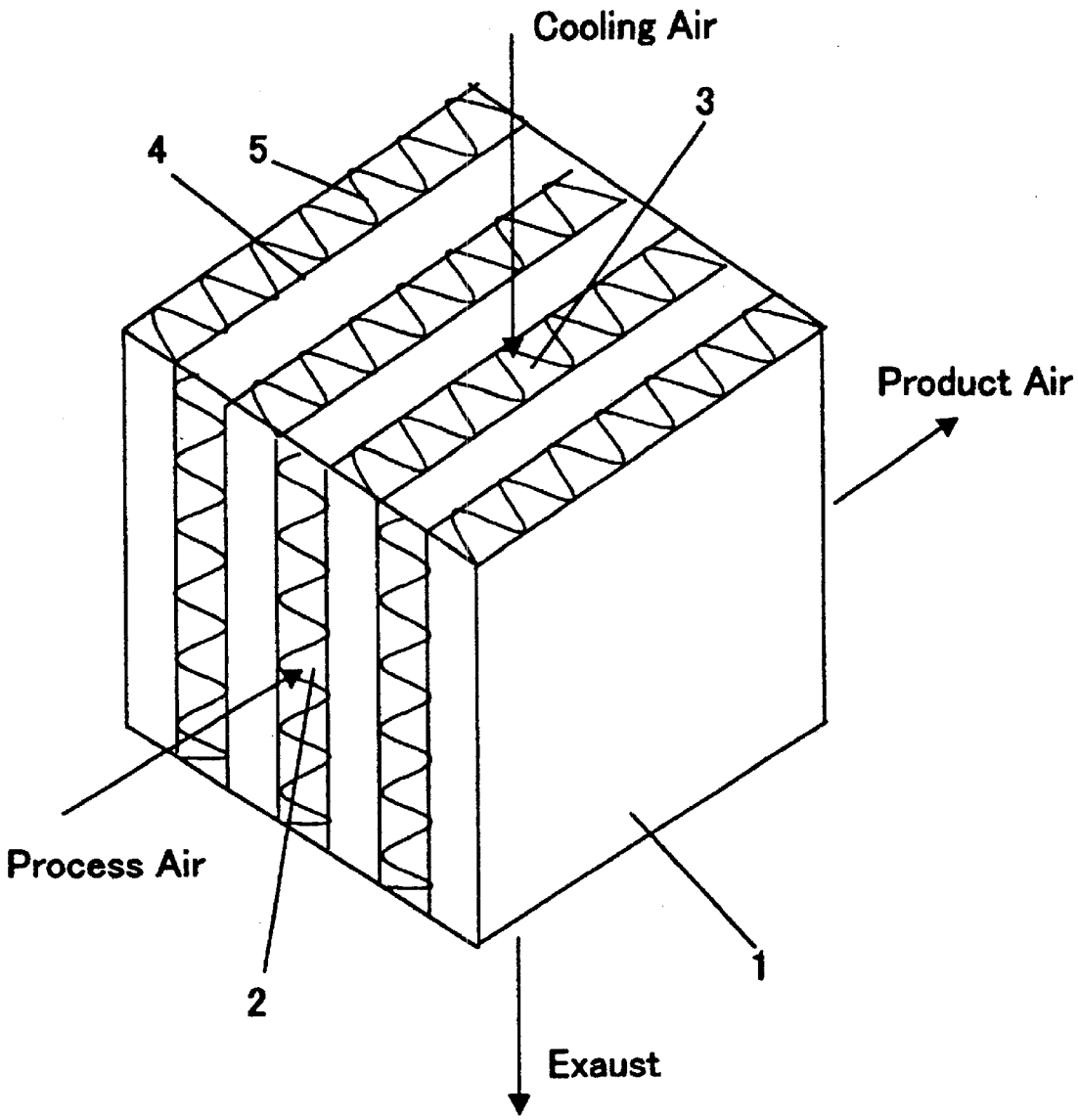
FIG. 1 is a perspective view of a device for illustrating the principle in an adsorption process.

Reference will now be made in detail to the preferred embodiments of the present invention, examples of which are illustrated in the accompanying drawings, wherein like reference numerals refer to like elements throughout.

Figure 2:
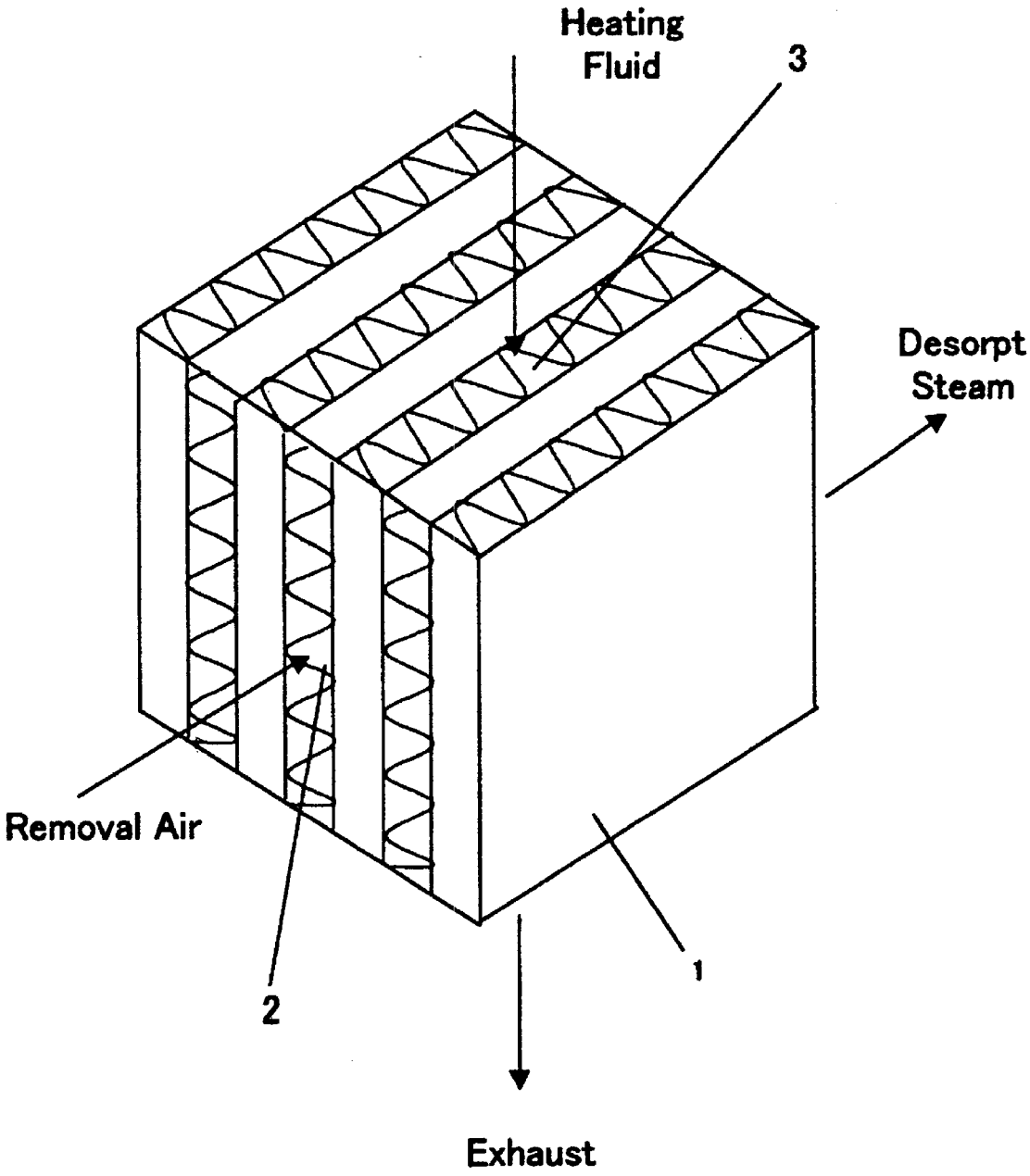
FIG. 2 is a perspective view of a device illustrating a desorption process.

FIG. 1 is a perspective view of a device illustrating an adsorption process. FIG. 2 is a perspective view of a device illustrating a desorption process.

In FIGS. 1 and 2, an adsorption element 1 has a cross flow type with a first passages 2 and a second passages 3. For the adsorption process illustrated in FIG. 1, process air flows into the first passages 2, and cooling air flows into the second passages 3. These passages are formed by successively laminating planer sheets 4 and wavelike sheets 5. The axes of lamination for sheets 5 is shifted 90 degrees between layers.

For the desorption process shown in FIG. 2, removal air is sent through the first passages 2. The removal air washes away the moisture desorbed within passages 2. To assist in this function, a heating fluid, such as steam, or hot moist air having a temperature of perhaps 60 degrees C and a relative humidity of perhaps 90% may be used. Alternatively, hot water having a temperature of perhaps 60 degrees Celsius may be used.

Figure 3:
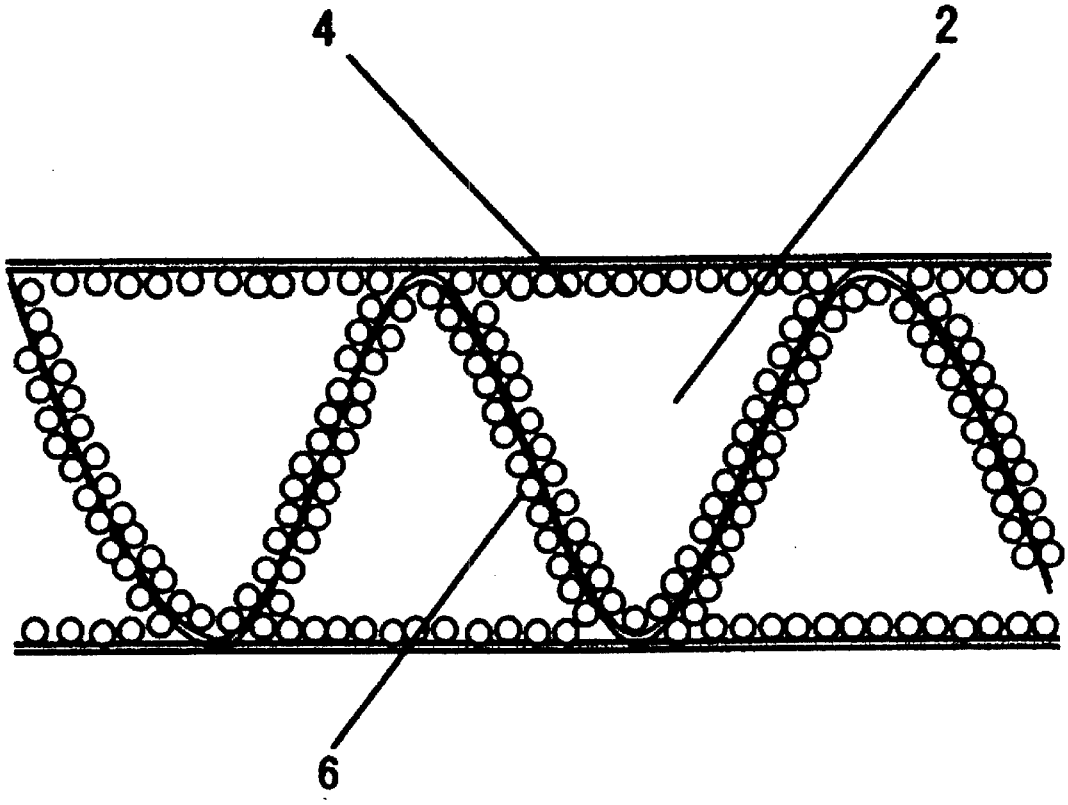
FIG. 3 is enlarged view of first passages of the device shown in FIGS. 1 and 2, to illustrate the adsorbent materials formed therein.

FIG. 3 is an enlarged view of first passages 2 of device shown in FIGS. 1 and 2, to illustrate the adsorbent materials formed therein. Moisture adsorbent 6, perhaps silica gel, an ion exchange resin or a hydrophilic zeolite, is formed on the inside of the first passages 2.

Figure 4:
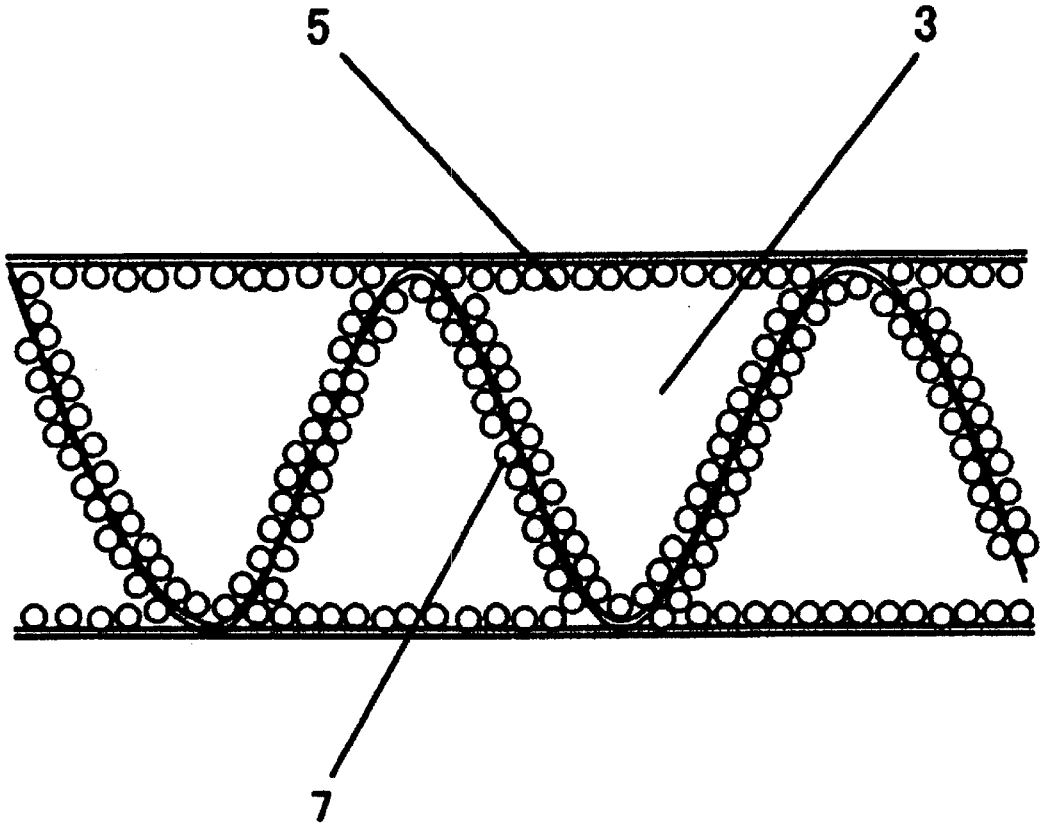
FIG. 4 is a partially enlarged view of second passages of the device shown in FIGS. 1 and 2, for illustrating the adsorbent formed therein.

FIG. 4 is a partially enlarged view of second passages 3 of the device shown in FIGS. 1 and 2, for illustrating the adsorbent formed therein. Silica gel, an ion exchange resin or a hydrophilic zeolite may also be used as the adsorbent 7 in second passages 3 for absorbing for retaining water. Instead of fixing the moisture absorbent 7 to the second passages 3, it is possible to make the second passages 3 hydrophilic by an aluminum oxide alumite processing or by providing fine irregularities or the surface of the laminated sheets.

Figure 5:
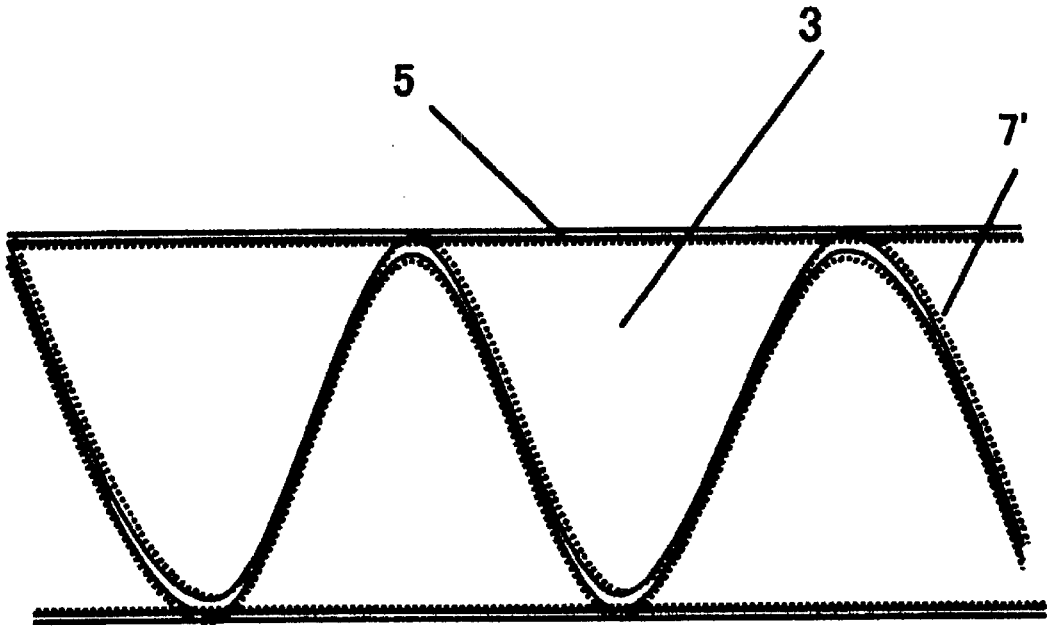
FIG. 5 is an enlarged view of second passages shown FIGS. 1 and 2, for illustrating an alternative to the FIG. 4 configuration.

FIG. 5 is an enlarged view of the second passages 3 shown FIGS. 1 and 2, for illustrating an alternative to the FIG. 4 configuration. In FIG. 5, a non-woven fabric 7' is pasted to the inner walls of the second passages 3. A porosity cement can also be applied.

The absorption element 1 dehumidifies as follows. Fist, the moisture adsorbent 7 or 7' on the inside of the second passages 3 is wet with water. Next, process air, perhaps outer air, is passed through the first passages 2 while cooling air, for example outer air is passed through second passages 3. With these actions, the absorbent 6 in first passages 2 adsorbs moisture in the process air and produces dry air from the first passages. As the adsorbent 6 in the first passages 2 adsorbes, the adsorbent 7 or 7' in the second passages 3 is heated by the heat of adsorption. This causes the adsorbent 7 or 7' to release moisture. That is, the water in adsorbent 7 or 7' evaporates. Cooling air flowing through second passages 3 carries the moisture from the adsorbent 7 or 7' to outside. The cooling air flowing through second passages 3 cools the adsorbent 7 or 7'. In this manner, the heat generated by adsorbent 6 is removed from passages 3. The temperature in the first passages 2 is maintained low. Effective dehumidification is achieved.

When the adsorbent 6 in the first passages 6 becomes filled with water, dehumidification becomes impossible. At this point, desorption is performed. As illustrated in FIG. 2, a heating fluid is passed through the second passages 3. The heating fluid may have a temperature of 50 to 100 degrees C. Hot water, steam or highly humid warm air (high relative humidity and temperature of 50 to 100° C.) may be used as the heating fluid. The water in the heating fluid is adsorbed by adsorbent 7 or 7' to remain in the second passages 3 during the dehumidification process. Dew is produced in the second passages 3.

By passing heating fluid through the second passages 3, the temperature of the second passages 3 rises from the sensible heat of the heating fluid. This sensible heat travels to the first passages 2, to cause desorption of the moisture contained in adsorbent 6 in the first passages 2. At the same time, removal air is passed through the first passages 2 to carry out and discharge the desorbed moisture as steam.

When the desorption of the moisture retained by adsorbent 6 in the first passages 2 is fully carried out, the flow of the heating fluid to the second passages 3 is stopped. A judgment of whether full desorption of the moisture retained by adsorbent 6 has occurred is made by measuring the humidity of the air exiting the first passages 2. If the humidity of the air exiting the first passages 2 sufficiently falls, it is presumed that desorption of the moisture adsorbent 6 was fully carried out. Alternatively, the length of time during which the heating fluid passes through the second passages 3 can be used. In this case, after a predetermined time, it is presumed that desorption is complete.

As a further alternative, the temperature difference of heating fluid entering the second passages and heating fluid exiting the second passages can be used, such that when the temperature difference reaches a predetermined difference, it is presumed that desorption is complete.

When desorption of the moisture adsorbent 6 in the first passages 2 is complete, the moisture adsorbent 7 in the second passages 3 will be wet from the heating fluid used in desorption. Therefore, it is not necessary to wet the moisture adsorbent 7 before restarting the dehumidification (adsorption) process. Dehumidification of a room can be done by cycling the about dehumidification (adsorption) and desorption processes.

Figure 6:
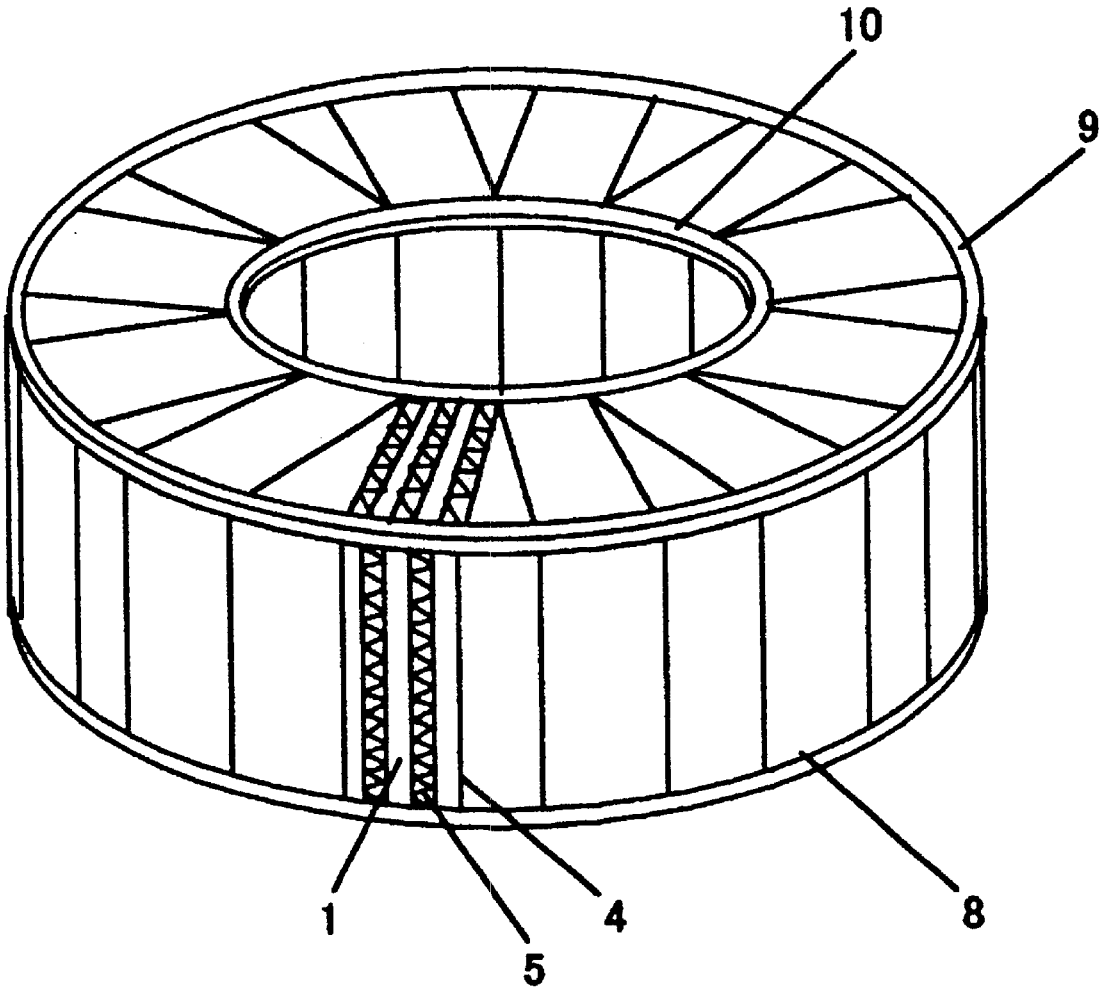
FIG. 6 is a perspective diagram of an adsorption rotor according to a second preferred embodiment of the present invention.
Figure 7:
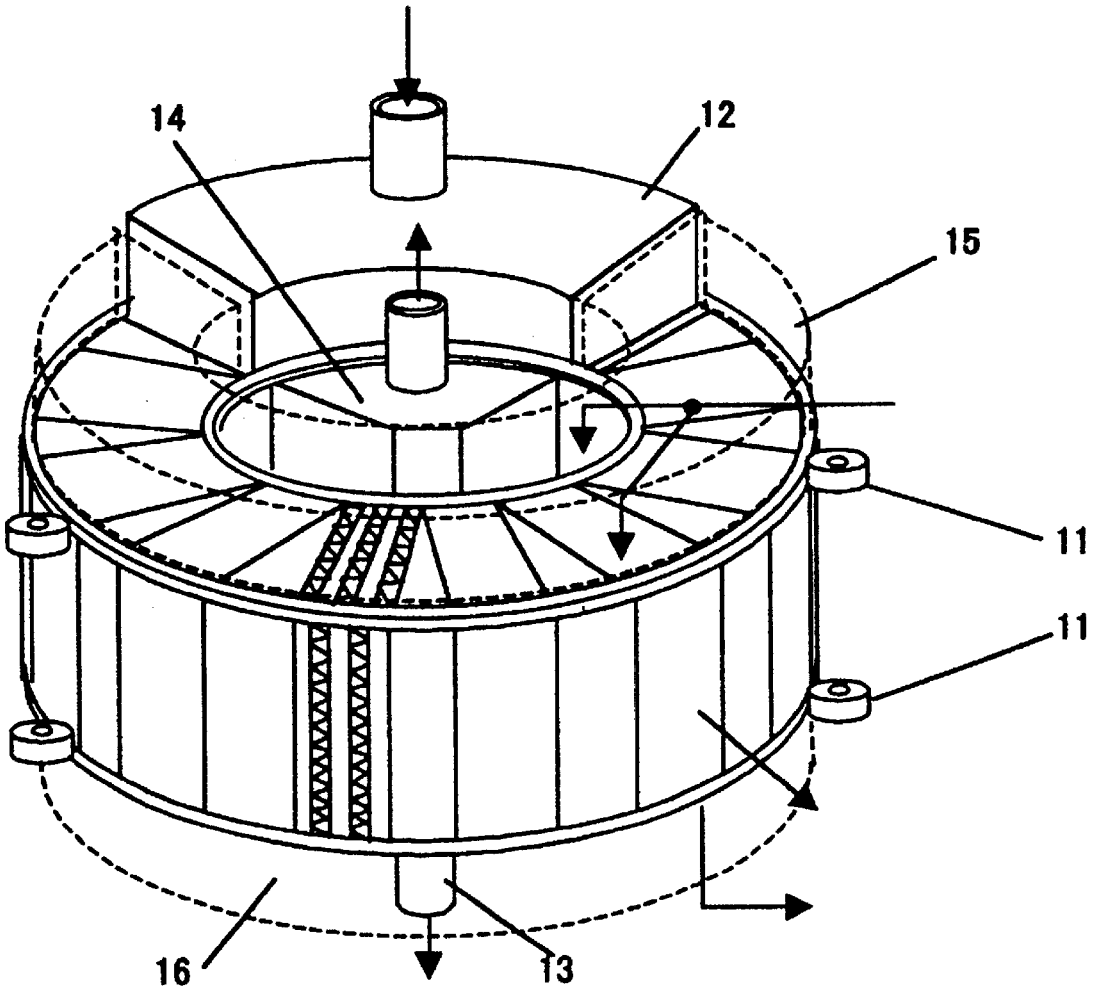
FIG. 7 is a perspective diagram of a dehumidifier, incorporating the rotor shown in FIG. 6, of the second preferred embodiment of the invention.
Figure 8:
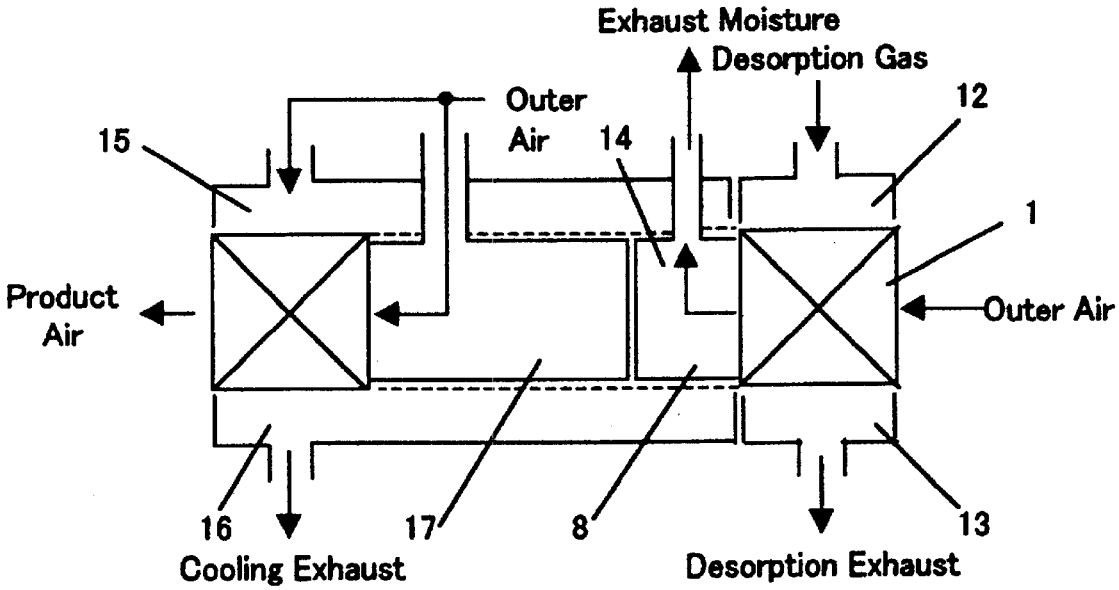
FIG. 8 is an air flow diagram showing the flow of the air the dehumidifier shown in FIG. 7.

A second preferred embodiment of the present invention will now be described. FIG. 6 is a perspective diagram of an adsorption rotor 8 according to the second preferred embodiment of the present invention. FIG. 7 is a perspective view of a dehumidifier, incorporating the adsorption rotor 8 shown in FIG. 6, according to the second preferred embodiment of the present invention. FIG. 8 is an air flow chart showing how air flows through the dehumidifier shown in FIG. 7.

As shown in FIG. 6, the second preferred embodiment employs a rotor 8 having a plurality of adsorption elements 1 in an annular arrangement. The adsorption rotor 8 enables the adsorption and desorption processes to be run continuously. In FIG. 6, adsorption rotor 8 has twelve adsorption elements 1. Since all adsorption elements 1 are the same, only one adsorption element 1 is illustrated. However, all adsorption elements 1 include plane sheets 4 and wavelike sheets 5. Large annular rings 9 and small annular rings 10 are positioned as shown. These rings 9, 10 may be made of a steel material and may have an "L" shaped cross section. The large annular rings 9 and small annular rings 10 assist in combining the plurality of adsorption elements 1 by fixing upper and lower sides of the rotor 8.

Referring to FIG. 7, the adsorption rotor 8 is rotatably supported with rollers 11. There are only two pairs of rollers shown in FIG. 7. However, three pairs of rollers may be required to support the adsorption rotor 8. One pair of rollers 11 is hidden from view behind a desorption inlet chamber 12. The adsorption rotor 8 is driven by a motor (not shown).

The desorption inlet chamber 12 communicates with the upper surface of the adsorption rotor 8. Through the desorption inlet chamber 12, hot desorption gas, such as steam, is passed to the upper surface of the adsorption rotor 8.

The desorption inlet chamber 12 is fixed to a frame, which supports the entire device, so that the desorption inlet chamber does not rotate with the adsorption rotor 8. The desorption inlet chamber 12 may cover one fourth of the upper surface of the adsorption rotor 8.

A desorption outlet chamber 13 is formed in a position to oppose the desorption inlet chamber 12, so that desorption gas introduced by the desorption inlet chamber 12 is removed from the adsorption rotor 8 by the desorption outlet chamber 13. In FIG. 7, only a portion of the desorption outlet chamber 13 can be seen.

A desorption exhaust chamber 14 is formed to communicate with an inner surface of the adsorption rotor 8. The desorption exhaust chamber 14 is formed at the same angular position as the desorption inlet and outlet chambers 12, 13. The desorption exhaust chamber 14 may be fixed to the frame supporting the entire device. Similar to the desorption inlet and outlet chambers 12, 13, the desorption exhaust chamber 14 may cover one fourth of the adsorption rotor inner surface. With the desorption exhaust chamber 14, air entering the perimeter of the adsorption rotor 8 is discharged via the desorption exhaust chamber 14.

With reference to FIGS. 7 and 8, a cooling inlet chamber 15 is formed to communicate with the upper surface of the adsorption rotor. It may cover the three fourths of the upper surface not covered by the desorption inlet chamber 12. A cooling outlet chamber 16 is formed to communicate with the lower surface of the adsorption rotor 8, at a position corresponding to that of the cooling inlet chamber 15. Accordingly, the cooling outlet chamber 16 may cover the three fourths of the adsorption rotor lower surface, not covered by the desorption outlet chamber 13. In FIG. 7, both of cooling inlet and outlet chambers 15, 16 are shown with dotted lines.

Air to be processed air enters the adsorption rotor 8 from the cooling inlet chamber 18. The air to be processed is usually outside air, i.e., air taken from a source other than the controlled atmosphere. It is alternatively possible to use room air as the air to be processed. After passing through the adsorption rotor 8, the air is discharged to the controlled atmosphere via the cooling exhaust chamber 16. Both the cooling inlet and exhaust chambers 15, 16 are fixed to the frame, so as not to rotate with the adsorption rotor 8. Referring to FIG. 8, a processed air inlet chamber 17 is formed to communicate with the inner surface of the adsorption rotor 8. The processed air inlet chamber 17 may cover the three fourths of the inner surface not covered by the desorption exhaust chamber 14. Air which enters the adsorption rotor 8 from the air inlet chamber 17 is discharged from the perimeter of the adsorption rotor 8 as product air. As is the previous chambers, processed air inlet chamber 17 is fixed to the frame, which supports the entire device.

The operation of the second embodiment will now be described. First, the operation of the adsorption element(s) 1, which encounter the desorption inlet chamber 12, the desorption outlet chamber 13, and the desorption exhaust chamber 14 will be described.

Desorption gas, such as steam or highly humid hot air having a temperature of 50° C. to 100° C. is sent through the desorption inlet chamber 12. From there, the desorption gas passes through the second passages 3 of the adsorption element(s) 1. The desorption gas heats the first passages 2 and is discharged from the adsorption rotor 8 via the desorption outlet chamber 13. A portion of the moisture in the desorption gas is adsorbed on the adsorbent 7 within the second passages 3. This may occur because of dew within the desorption gas condensing as heat passes from the second passages 3 to the first passages 2.

The desorption action in the first passages 2 will now be described. Outer air is sent through first passages 2 and is heated by the desorption gas, as described above. This heating causes the adsorbent 6 in the first passages 2 to desorb moisture so that the moisture can be discharged together with the heated outer air via desorption exhaust chamber 14.

The adsorption operation will now be described. Outer air is sent to both the cooling inlet chamber 15 and the processed air inlet chamber 17, as shown in FIG. 8. From the processed air inlet chamber 17, the air is sent through the first passages 2. In the first passages 2, moisture is adsorbed by the adsorbent 6. This dried air is released from the first passages 2, perhaps to the room, for subsequent use. Dehumidification is continuous. As adsorbent 6 in the first passages 2 adsorbs moisture, heat is generated thereby. This heat travels to the second passages 3 to increase the temperature in the second passages 3. As mentioned above, the adsorbent 7 in the second passages 3 adsorbed moisture during the desorption process. This moisture in the second passages 3 evaporates and is desorbed by the adsorption heat in first passages 2. The evaporation reduces the temperature in the second passages 3 and thereby the first passages 2.

From cooling inlet chamber 15, air is sent through the second passages 3. This air serves to cool the second passages 3 (and first passages 2). This air also carries out moisture desorbed from the adsorbent 7 in the second passages 3. From the second passages 3, the air is released via cooling exhaust chamber 16. The adsorption heat released by the heat of desorption/evaporation in the second passages 3 suppresses any temperature increase in the first passages 2. In this manner, the performance of the adsorbent 6 in the first passages 2 can be maintained that a high level.

Figure 9:
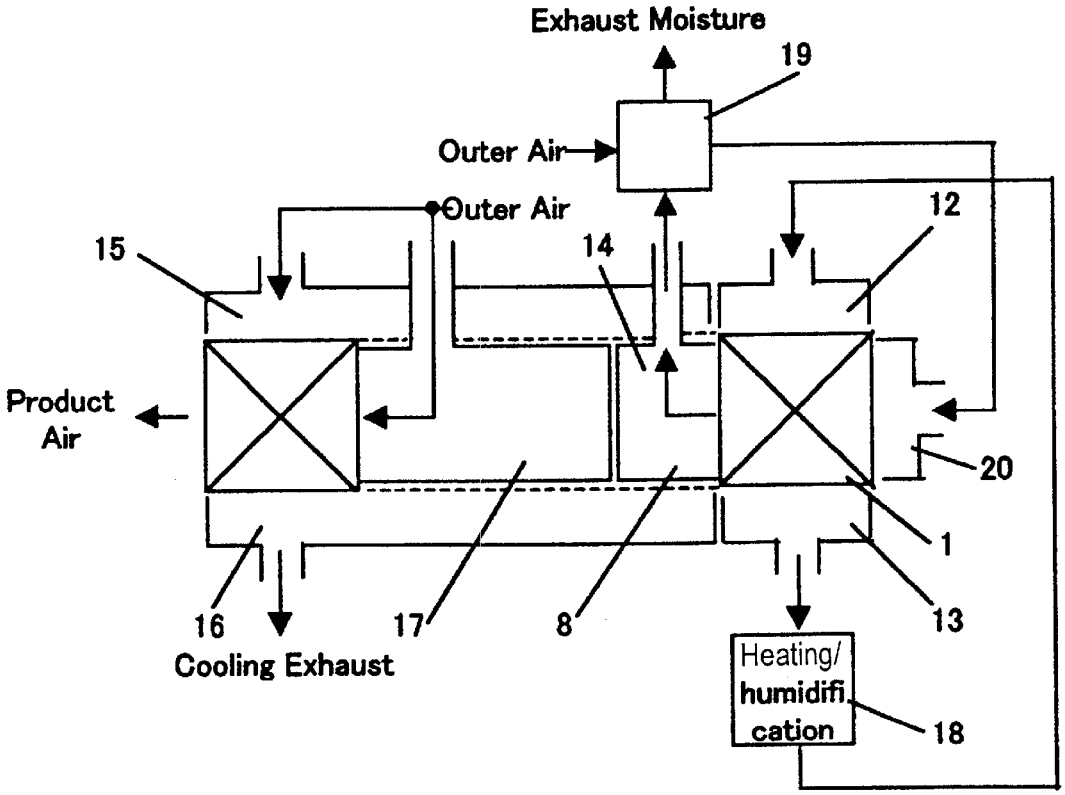
FIG. 9 is a diagram showing air flow within a dehumidifier according to a third preferred embodiment of the present invention.

A third preferred embodiment of the present invention is shown in FIG. 9, which is a diagram showing air flow within a dehumidifier according to a third preferred embodiment of the present invention. The equipment of the third preferred embodiment is substantially the same as that of the second preferred embodiment. The third preferred embodiment, however, may have a greater thermal efficiency than that of the second preferred embodiment. The elements of the third preferred embodiment are represented by the same reference numerals as that of the second preferred embodiment. A duplicate description will be omitted.

Comparing FIGS. 8 and 9, the third preferred embodiment has heating humidification equipment 18 and a cross-flow heat exchanger 19. The heating/humidification equipment 18 is connected to the exit of the desorption outlet chamber 13 and supplies heat and moisture to the air, which heat and moisture were lost when the air traversed the second passages 3. After heating and humidification, the air is sent to the desorption inlet chamber 12 as desorption gas.

The cross-flow heat exchanger 19 is formed so that heat is exchanged between the desorbed air and removal air. The cross-flow heat exchanger 19 receives air from the desorption exhaust chamber 14. This air is sent through one of the passages of the heat exchanger 19. Through the other passages, outer air is warmed, before sending the outer air to the desorption entrance chamber 20.

The equipment of the third embodiment is generally the same as equipment of the second embodiment. However, since waste heat is recovered by the cross-flow heat exchanger 19, and because the desorption gas is recycled via the heating/humidification equipment 18, the third preferred embodiment has a higher thermal efficiency than the second preferred embodiment.

The first through third embodiments have been described with reference to water remaining in the second passages 3 after desorption. Alternatively, it is possible to spray water into the second passages 3 during the dehumidification process. Air having a large amount of misty minute liquid drops could also be passed through the second passages 3 during the dehumidification process. The same dehumidification effect can be achieved as was achieved with the first through third preferred embodiments.

Although preferred embodiments of the present invention have been shown and described, it will be appreciated by those skilled in the art that changes may be made in these embodiments without departing from the principle and spirit of the invention, the scope of which is defined in the appended claims and their equivalents.

What is claimed is:

1. A dehumidifying method comprising:

during a first time period, passing air to be dehumidified through first passages of a heat exchanger having first and second passages, the first and second passages having therein first and second moisture adsorbents, respectively;

during the first time period, passing cooling air through the second passages of the heat exchanger to remove heat generated in the first passages;

during a second time period, passing a heating fluid through the second passages of the heat exchanger to heat the first passages and supply moisture for adsorption to the second moisture adsorbent; and during the second time period, passing removal air through the first passages of the heat exchanger to eliminate water adsorbed by the first moisture adsorbent during the first time period, wherein a plurality of heat exchangers are arranged in a circular configuration, the method further comprising rotating the circular configuration so that steps of the first time period are performed for a first portion of the heat exchangers concurrently with steps of the second time period for a second portion of the heat exchangers, and the cooling air that passes through the second passages of the heat exchanger during the first time period desorbs moisture adsorbed by the second moisture adsorbent during the second time period.

2. A dehumidifying method according to claim 1, wherein the first moisture adsorbent in the first passages of the heat exchanger is selected from the group consisting of silica gel, an ion exchange resin, and a hydrophilic zeolite.

3. A dehumidifying method according to claim 1, wherein the second moisture adsorbent in the second passages of the heat exchanger is selected from the group consisting of silica gel, an ion exchange resin, a hydrophilic zeolite, and a non-woven fabric.

4. A dehumidifying method according to claim 1, wherein the second moisture adsorbent in the second passages of the heat exchanger is formed by surface processing on the surfaces of the second passages.

5. A dehumidifying method according to claim 1, wherein the heating fluid is warm humid air, in the step of passing the heating fluid through the second passages of the heat exchanger, air exiting the second passages of the heat exchanger is introduced to a heating and humidifying device, and air exiting the heating and humidifying device is recirculated to be passed through the second passages of the heat exchanger as the heating fluid.

6. A dehumidifying method according to claim 1, wherein the heat exchanger is a cross flow heat exchanger.

7. A dehumidifying method according to claim 1, wherein in the step of passing removal air through the first passages of the heat exchanger, the removal air is heated by a heater before passing through the first passages of the heat exchanger, air exiting the first passages of the heat exchanger is sent through first passages of a desorption heat exchanger having first and second passages, and before heating by the heater, removal air is passed through the second passages of the desorption heat exchanger to thereby preheat the removal air.

8. A dehumidifying method comprising:

during a first time period, passing air to be dehumidified through first passages of a heat exchanger having first and second passages, the first passages having therein a moisture adsorbent;

supplying moisture to the second passages of the heat exchanger;

during the first time period, passing cooling air through the second passages of the heat exchanger to remove heat generated in the first passages and to evaporate moisture supplied to the second passages;

during a second time period, passing warm air through the second passages of the heat exchanger to heat the first passages; and during the second time period, passing removal air through the first passages of the heat exchanger to eliminate water adsorbed by the moisture adsorbent during the first time period, wherein a plurality of heat exchangers are arranged in a circular configuration, the method further comprising rotating the circular configuration so that steps of the first time period are performed for a first portion of the heat exchangers concurrently with steps of the second time period for a second portion of the heat exchangers.

9. A dehumidifying method according to claim 8, wherein the moisture adsorbent in the first passages of the heat exchanger is selected from the group consisting of silica gel, an ion exchange resin, and a hydrophilic zeolite.

10. A dehumidifying method according to claim 8, wherein the heat exchanger is a cross flow heat exchanger.

11. A dehumidifying method according to claim 8, wherein moisture is supplied to the second passages of the heat exchanger in the step of passing cooling air through the second passages of the heat exchanger, the moisture being supplied by passing air having a large amount of misty minute liquid drops floating therein through the second passages of the heat exchanger.

12. A dehumidifying method according to claim 8, wherein moisture is supplied to the second passages of the heat exchanger by adding water to the second passages of the heat exchanger before the first time period.

13. A dehumidifying method according to claim 8, wherein in the step of passing removal air through the first passages of the heat exchanger, the removal air is heated by a heater before passing through the first passages of the heat exchanger, air exiting the first passages of the heat exchanger is sent through first passages of a desorption heat exchanger having first and second passages, and before heating by the heater, removal air is passed through the second passages of the desorption heat exchanger to thereby preheat the removal air.

14. A dehumidifier comprising:

a plurality of heat exchangers arranged in a circular configuration, each heat exchanger having first and second passages, the first and second passages having therein first and second moisture adsorbents; and a frame rotatably supporting the plurality of heat exchangers, the frame having first and second areas through which the plurality of heat of exchangers are rotated, the first area having a channel (A)(1) to direct air to be dehumidified through the first passages of the heat exchanger, the first area also having a channel (A)(2) to direct cooling air through the second passages to remove heat generated in the first passages and to desorb moisture adsorbed by the second moisture adsorbent, and the second area having a channel (B)(1) to direct removal air through the first passages to eliminate water adsorbed by the first moisture adsorbent in the first area, the second area also having a channel (B)(2) to direct a heating fluid through the second passages to heat the first passages and supply moisture for adsorption to the second moisture adsorbent.

15. A dehumidifier according to claim 14, wherein the first moisture adsorbent in the first passages of the heat exchanger is selected from the group consisting of silica gel, an ion exchange resin, and a hydrophilic zeolite.

16. A dehumidifier according to claim 14, wherein the second moisture adsorbent in the second passages of the heat exchanger is selected from the group consisting of silica gel, an ion exchange resin, a hydrophilic zeolite, and a non-woven fabric.

17. A dehumidifier according to claim 14, wherein the second moisture adsorbent in the second passages of the heat exchanger is formed by surface processing on the surfaces of the second passages.

18. A dehumidifier according to claim 14, wherein the heating fluid is warm humid air, the dehumidifier further comprises a heating and humidifying device connected to channel (B)(2), to receive air exiting the second passages of the heat exchanger at the second area, heat and humidify the air and thereby form the heating fluid which is directed through the second passages of the heat exchanger in the second area.

19. A dehumidifier according to claim 14, wherein the heat exchanger is a cross flow heat exchanger.

20. A dehumidifier according to claim 14, further comprising:

a heater to heat the removal air before passing the removal air through channel (B)(1) and the first passages of the heat exchanger; and a desorption heat exchanger connected to channel (B)(1) and having first and second passages, the first passages of the desorption heat exchanger receiving air exiting the first passages of the heat exchanger in the second area, the second passages of the heat exchanger receiving removal air before the removal is heated by the heater.

21. A dehumidifier comprising:

a plurality of heat exchangers arranged in a circular configuration, each heat exchanger having first and second passages, the first passages having therein a moisture adsorbent; and a frame rotatably supporting the plurality of heat exchangers, the frame having first and second areas through which the plurality of heat of exchangers are rotated, the first area having a channel (A)(1) to direct air to be dehumidified through the first passages of the heat exchanger, the first area also having a channel (A)(2) to direct cooling air through the second passages to remove heat generated in the first passages and to evaporate moisture suppled to the second passages, and the second area having a channel (B)(1) to direct removal air though the first passages to eliminate water adsorbed by the moisture adsorbent in the first area, the second area also having a channel (B)(2) to direct a heating fluid through the second passages to heat the first passages.

22. A dehumidifier according to claim 21, wherein the adsorbent in the first passages of the heat exchanger is selected from the group consisting of silica gel, an ion exchange resin, and a hydrophilic zeolite.

23. A dehumidifier method according to claim 21, wherein the heat exchanger is a cross flow heat exchanger.

24. A dehumidifier according to claim 21, further comprising a spray device to supply a large amount of misty minute liquid drops to the second passages via channel (A)(2) to thereby supply the moisture to the second passages.

25. A dehumidifier according to claim 21, further comprising:

a heater to heat the removal air before passing the removal air through channel (B)(1) and the first passages of the heat exchanger; and a desorption heat exchanger connected to channel (B)(1) and having first and second passages, the first passages of the desorption heat exchanger receiving air exiting the first passages of the heat exchanger in the second area, the second passages of the heat exchanger receiving removal air before the removal is heated by the heater.

26. A dehumidifying method according to claim 1, wherein the first moisture adsorbent in the first passages of the heat exchanger is selected from the group consisting of silica gel, an ion exchange resin, and a hydrophilic zeolite.

27. A dehumidifying method according to claim 1, wherein the second moisture adsorbent in the second passages of the heat exchanger is selected from the group consisting of silica gel, an ion exchange resin, a hydrophilic zeolite, and a non-woven fabric.

28. A dehumidifying method according to claim 1, wherein the second moisture adsorbent in the second passages of the heat exchanger is formed by surface processing on the surfaces of the second passages.

29. A dehumidifying method according to claim 8, wherein the adsorbent in the first passages of the heat exchanger is selected from the group consisting of silica gel, an ion exchange resin, and a hydrophilic zeolite.

* * * * *